US006591082B2

(12) United States Patent
Samei et al.

(10) Patent No.: US 6,591,082 B2
(45) **Date of Patent: *Jul. 8, 2003**

(54) PRINTER AND FIXING DEVICE WHICH MAINTAIN A STABLE TEMPERATURE FOR FIXING A TONER IMAGE

(75) Inventors: Masahiro Samei, Fukuoka (JP); Kazunori Matsuo, Fukuoka (JP); Tomoyuki Noguchi, Fukuoka (JP); Yukinori Hara, Fukuoka (JP)

(73) Assignee: Matsushita Electric Industrial, Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/022,621

(22) Filed: Dec. 20, 2001

(65) Prior Publication Data

US 2002/0085867 A1 Jul. 4, 2002

(30) Foreign Application Priority Data

Dec. 22, 2000 (JP) ..... 2000-390091

(51) Int. Cl.[7] ..... G03G 15/20
(52) U.S. Cl. ..... 399/329; 219/216; 219/619
(58) Field of Search ..... 399/329, 328; 219/216, 618, 619, 645

(56) References Cited

U.S. PATENT DOCUMENTS 6,154,629 A * 11/2000 Kinouchi et al. ..... 399/329
6,321,059 B1 * 11/2001 Tamura ..... 399/302
6,449,457 B2 * 9/2002 Samei et al. ..... 399/328

FOREIGN PATENT DOCUMENTS

| | | | |
|---|---|---|---|
| EP | 1 174 774 A1 | * | 1/2002 |
| JP | 63-313182 | | 12/1988 |
| JP | 01-263679 | | 10/1989 |
| JP | 2001060049 A | * | 3/2001 |
| JP | 2001125407 A | * | 5/2001 |
| JP | 2001318546 A | * | 11/2001 |
| WO | 00/52534 | | 9/2000 |

OTHER PUBLICATIONS

Abstract of WO 00/52534, Sep. 2000.*

* cited by examiner

*Primary Examiner*—Joan Pendegrass
(74) *Attorney, Agent, or Firm*—Wenderoth, Lind & Ponack, L.L.P.

(57) ABSTRACT

A printer includes, in its fixing device operable to fix toner particles onto a recording medium, a heating roller containing magnetic metal, a fixing roller disposed parallel to the heating roller, an endless belt containing magnetic metal bridged across the heating roller and the fixing roller. The printer also includes a press roller pressed to the fixing roller via the endless belt and the recording medium, and a coil core being operable to produce magnetic fields so as to cause both of the heating roller and the endless belt to generate heat with the magnetic metals contained therein.

22 Claims, 5 Drawing Sheets

PRINTER AND FIXING DEVICE WHICH MAINTAIN A STABLE TEMPERATURE FOR FIXING A TONER IMAGE

FIELD OF THE INVENTION

The present invention relates to a printer, or a fixing device used for image forming devices such as copying machines, facsimiles and printers.

BACKGROUND OF THE INVENTION

Demands for faster and more energy-efficient image forming devices such as printers, copying machines and facsimiles have been increasing in the market. To satisfy such demands, it is critical to improve the thermal efficiency of fixing devices used in the image forming devices.

During image forming processes such as electrophotographic recording, electrostatic recording and magnetic recording, an image forming device forms an unfixed toner image on recording media by as recording sheets, photosensitive paper and electrostatic recording paper by an image transfer method or a direct method. The unfixed toner image is fixed, in general, by a fixing device based on contact heating methods such as a hot roller method, a film heating method, or an electromagnetic induction heating method.

The fixing device of the hot roller method comprises, as a basic construction, a pair of rollers including a temperature regulated fixing roller having a heat source such as a halogen lamp and a press roller pressing against the fixing roller. A recording medium is inserted into and carried through a section where the fixing roller and press roller come into contact, a so-called fixing nip portion, so that the unfixed toner image is melted and fixed by heat and pressure applied by the rollers.

The fixing device of the film heating method is disclosed, for example, in the Japanese Patent Laid-Open Publications S63-313182 and H01-263679.

In the case of the foregoing fixing device, a recording medium is positioned into a close contact with a heater which is tightly fixed to a supporting member via a thin heat-resistant fixing film. The fixing film is slid against the heating body and the heat is transferred from the heating body to the recording medium via the film.

International Publication WO 00/52534 A1 discloses a fixing device based on the electromagnetic induction heating method. According to the method, Joule heat produced by an eddy current generated in a magnetic metal member by an alternating field heats up a heater, including the metal members, by an electromagnetic induction. A heating roller is heated by electromagnetic induction heating, and the heat is transferred to a thin heating medium made of a heat-resistant resin by thermal conduction.

SUMMARY OF THE INVENTION

The present invention aims to provide a printer in which a stable temperature for fixing a toner image can be maintained stable.

The printer of the present invention comprises an exposure device for generating a light beam corresponding to an image information, a photosensitive body on which a latent image is formed based on the light beam delivered from the exposure means, a charger for charging the photosensitive body, a developer for converting the latent image formed on the photosensitive body into a visible image using toner particles, a belt on which the visible toner image is transferred, and a fixing device for fixing the toner image on the belt onto a recording medium.

The foregoing fixing device comprises a heating roller containing a magnetic metal, a fixing roller disposed parallel to the heating roller, an endless belt bridging the heating roller and the fixing roller, a press roller pressed to the fixing roller via the endless belt and recording medium, and a device for producing magnetic fields disposed adjacent to the heating roller.

The endless belt contains magnetic metal or the belt is made of materials that can be heated by magnetic induction heating. The device for producing magnetic fields causes both of the heating roller and the endless belt to generate heat.

DESCRIPTION OF THE PREFERRED EMBODIMENT

Figure 1:
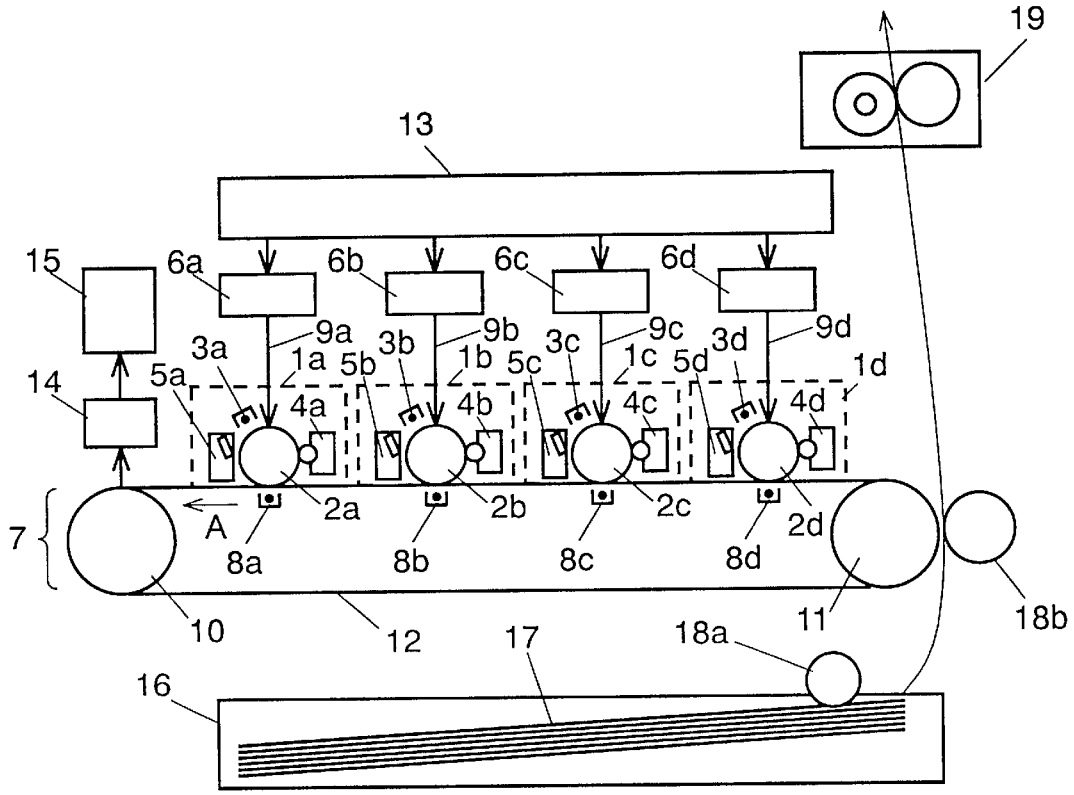
FIG. 1 shows an outline concept of a printer in accordance with an exemplary embodiment of the present invention.

Exemplary embodiments of the present invention are described with reference to the drawings, using a printer comprising a color image forming device as an example.

The elements commonly shown in the drawings are shown with the same numerals, and redundant descriptions are omitted.

Referring to FIG. 1, a color image forming device comprises four image stations 1*a*, 1*b*, 1*c*, 1*d*. Each of the respective image stations has a photosensitive drum (photosensitive body), or an image bearer, 2*a*, 2*b*, 2*c*, 2*d*, respectively, accompanied by charging means or chargers 3*a*, 3*b*, 3*c*, 3*d* for electrostatically charging the surface of the drum homogeneously, developing means or developers 4*a*, 4*b*, 4*c*, 4*d* for converting an electrostatic latent image into a visible image, and cleaning means or cleaners 5*a*, 5*b*, 5*c*, 5*d* for removing residual toner particles staying on the drum surface. Exposure means or exposure devices 6*a*, 6*b*, 6*c*, 6*d*, which are a scanning optical system, irradiate light on the photosensitive drums 2*a*, 2*b*, 2*c*, 2*d*, respectively, in accordance with information corresponding to an image. Image transfer means or an image transfer device 7 comprises an intermediary transfer belt (transfer member) 12 and transfer means or transfer devices 8*a*, 8*b*, 8*c*, 8*d* for transferring a toner image on the transfer belt.

At each of the respective image stations 1*a*, 1*b*, 1*c*, 1*d*, an image is reproduced in terms of yellow, magenta, cyan and black color components, respectively.

Each of the exposure means or the exposure devices 6*a*, 6*b*, 6*c*, 6*d*, outputs a light beam 9*a*, 9*b*, 9*c*, 9*d* that corresponds to the yellow, magenta, cyan and black components, respectively.

Under the image stations 1*a,* 1*b,* 1*c,* 1*d,* an intermediary transfer belt 12 in the form of an endless belt is provided bridging the rollers 10 and 11. The endless belt travels in a direction as indicated with an arrow A.

Pattern detection means or pattern detector 14 is provided facing towards the intermediary transfer belt 12 for detecting a resist pattern generated from resist pattern generating means or a resist pattern generator 13. Further, dislocation correction means or dislocation corrector 15 is provided for correcting dislocation in each of the colors, based on detection results delivered from the pattern detection means or pattern detector 14. The pattern detection means or pattern detector 14 is disposed at both ends of the transfer belt 12 in the width direction.

Sheets 17 stored in a dispensing cassette 16 are supplied by a paper feed roller 18*a,* and discharged to a discharge tray (not shown) via a transferring roller and fixing means or a fixing device 19.

In the above-configured color image forming device, a latent image corresponding to the black component is formed on the photosensitive drum 2*d* at the image station 1*d* by a known electro-photographic process using the charging means or charger 3*d* and the exposure means or exposure device 6*d.* The latent image is made into a visible black toner image at the developing means or developer 4*d* using a developer containing black toner particles. The black toner image is transferred at the transfer means or transfer device 8*d* to the intermediary transfer belt 12.

When the black toner image is being transferred to the intermediary transfer belt 12, a latent image corresponding to the cyan component is formed at the image station 1*c.* This latent image is made into a cyan toner image at the developing means or developer 4*c* and transferred at the transfer means or transfer device 8*c* to be overlaid on the black toner image which had been transferred to the intermediary transfer belt 12.

The magenta toner image and the yellow toner image are likewise processed. When all of the four toner images are overlaid on the intermediary transfer belt 12, paper or the like sheet 17 is delivered by a paper supply roller 18*a* from the dispensing cassette 16. The overlaid toner images are printed altogether on the sheet material by a transfer-printing roller 18*b,* and fixed by heating at the fixing means or fixing device 19 to yield a full-color image on the sheet material 17.

After the printing process is finished, respective photosensitive drums 2*a,* 2*b,* 2*c,* 2*d* have their surfaces cleaned to remove residual toner particles at the cleaning means or cleaners 5*a,* 5*b,* 5*c,* 5*d* in preparation for the next image formation. This completes a printing operation.

The process of fixing a color image in the present embodiment is described more in detail, referring to FIG. 2–FIG. 6.

Figure 2:
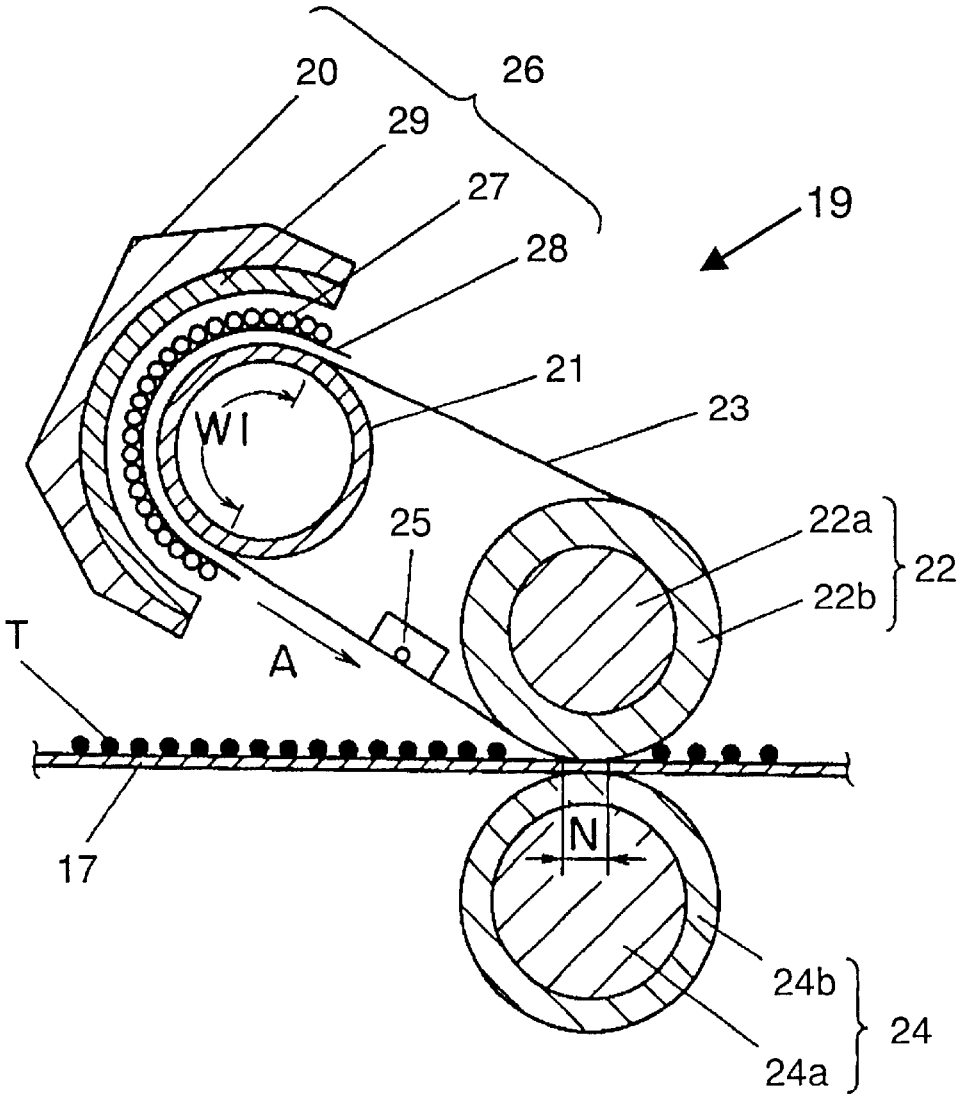
FIG. 2 shows a fixing device of the printer in accordance with a preferred embodiment of the present invention.

The fixing device in FIG. 2 comprises a heating roller 21 heated by electromagnetic induction of an induction heating means or an induction heater 26, a fixing roller 22 disposed in parallel to the heating roller 21, a heat-resistant endless belt (toner heating medium belt) 23 bridging across the heating roller 21 and the fixing roller 22, wherein the belt 23 is heated by the heating roller 21 and rotated by the rotation of one of the rollers in the direction shown by an arrow A, and a press roller 24 which is pressed to the fixing roller 22 via the belt 23 and rotates in the same direction as the belt 23.

The heating roller 21 is made of a hollow cylindrical magnetic metal such as iron, cobalt or nickel, and alloys of those metals. In this embodiment, the external diameter of the heating roller 21 is 20 mm and the thickness is 0.3 mm, and its temperature rises rapidly due to its low heat capacity.

The fixing roller 22 comprises a metallic core 22*a* made of such metals as stainless steel, and a resilient member 22*b* coating the metallic core 22*a.* The resilient member 22*b* is made of solid or foamed heat-resistant silicon rubber. The external diameter of the fixing roller 22 is 30 mm, and it is set larger than the heating roller 21 so that the press roller 24 and the fixing roller 22 come in contact at a predetermined width when pressed by the pressure of the press roller 24. The thickness of the resilient member 22*b* is 3–8 mm and the hardness is 15–50° (Asker hardness: hardness measured by JIS (Japan Industrial Standard) A is 6–25°). This configuration makes the heat capacity of the heating roller 21 smaller than that of the fixing roller 22 so as to heat the heating roller 21 rapidly, thereby shortening the warm-up time.

The belt 23 bridging the heating roller 21 and the fixing roller 22 is heated at a position W1 where it comes in contact with the heating roller 21 heated by the induction heating means or induction heater 26. As the rollers 21 and 22 rotate, the inner surface of the belt 23 is heated continuously, and in this manner, the entire belt is heated.

Figure 5:
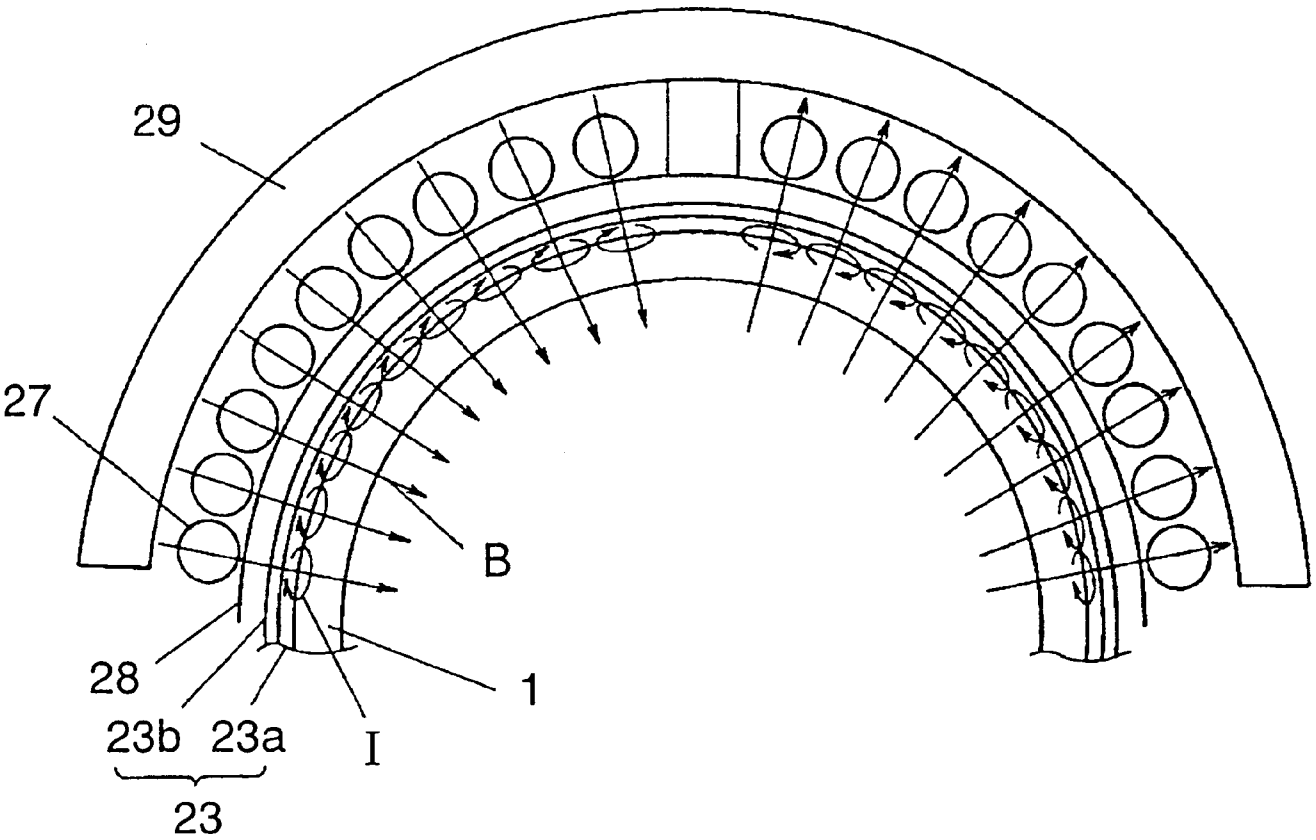
FIG. 5 is a schematic view showing an alternating magnetic field and a generation of eddy current in a printer of the present invention.

As FIG. 5 shows, the belt 23 is a composite layer belt which comprises a heating layer 23*a* made of magnetic metal such as iron, cobalt or nickel, or alloys of such metals as a base material, and a releasing layer 23*b* made of a resilient member such as silicon rubber and fluorocarbon rubber. The belt 23 is formed of a heating layer, a resilient layer and a releasing layer, stacked together in the order.

The composite layer helps to stabilize the temperature of the belt 23 and improves reliability even when a foreign object gets in between the belt 23 and the heating roller 21 and makes a gap. This is because heat from the heating layer 23*a* generated by the electromagnetic induction heats up the belt 23.

The thickness of the heating layer 23*a* is preferably 20–50 $\mu$m and in the present embodiment it is about 30 $\mu$m. If the heating layer 23*a* is thicker than 50 $\mu$m, distortion stress generated during the rotation of the belt becomes large. Consequently, shear force causes cracks and in some cases, lowers the mechanical strength significantly. When the heating layer 23*a* is thinner than 20 $\mu$m, thrust load generated by meandering of the belt during rotation is applied on the ends of the belt, causing cracks or fissures to develop in the composite layer belt.

The preferable thickness of the releasing layer 23*b* is between 100 and 300 $\mu$m and in the present embodiment it is around 200 $\mu$m. When the thickness is within this range, the toner image T formed on the recording medium 21 can be sufficiently enclosed by the surface layer of the belt 23, thus the toner image T can be heated and melted evenly.

When the releasing layer 23*b* is thinner than 100 $\mu$m, the thermal capacity of the belt 23 becomes small. As a consequence, the temperature on the surface of the belt drops significantly during the fixing process of the toner so that sufficient fixing cannot be maintained. On the other hand, if the releasing layer 23*b* is thicker than 300 $\mu$m, the heat capacity of the belt 23 becomes larger, extending the warm-up time. Furthermore, since the temperature of the surface of the belt does not drop quickly during the toner fixing process, solidification of the melted toner near the exit of the fixing section is hindered. As a result, so-called hot offset is triggered, lowering the releasing ability of the belt and allowing the toner to stick to the belt.

The inner surface of the heating layer 23*a* may be coated with resin in order to prevent oxidization of the metal and improve contact conditions with the heating roller 21.

As the base material of the belt 23, the heating layer 23*a* made of the above metals can be replaced with a heat-resistant resin layer made of such resins as fluorocarbon resins, polyimide resin, polyamide resin, polyamideimide resin, PEEK, PES, and PPS.

When the base material is made of a resin layer with a high heat-resistance, the belt 23 can easily fit on the heating roller 21 according to its curvature, and the heat from the heating roller 21 can be transferred to the belt 23 effectively.

In this case, the resin layer is preferably 20–150 μm and in the present embodiment it is around 75 μm in thickness. When the resin layer is thinner than 20 μm, sufficient mechanical strength against meandering during the rotation of the belt cannot be obtained. On the other hand, when the resin layer is thicker than 150 μm, the heat is not effectively transferred from the heating roller 21 to the releasing layer 23*b* of the belt 23, since the heat conductivity of the resin becomes small. As a result, the fixing condition deteriorates.

The base material can be made of an electro-conductive composite resin which can be heated by an electromagnetic induction heating. The resin materials for the electro-conductive composite resin may preferably include heat-resistant resins.

Referring to FIG. 2, the press roller 24 comprises a metal tube core 24*a* made of a metal with high heat conductivity such as copper and aluminum, and on the surface of the core 24*a,* a resilient member 24*b* having high heat-resistance and toner releasing ability. The metallic core 24*a* may be made of stainless steel in the place of the foregoing metals.

The press roller 24 presses the fixing roller 22 via the belt 23 and forms the fixing nip portion N. However, in the present embodiment, since the press roller 24 is harder than the fixing roller 22, the press roller 24 presses into the fixing roller 22 (and the belt 23). Due to this, the medium 17 follows the outer periphery of the press roller 24, improving the releasing ability of the medium 17 from the belt 23. The external diameter of the press roller 24 is approximately 30 mm, almost the same as that of the fixing roller 22. However, the thickness of resilient member 24*b* is about 2–5 mm, thinner than the fixing roller 22, and surface hardness is 20–60° (Asker hardness: hardness measured by JIS A is 6–25°), harder than the fixing roller 22 as mentioned previously.

Figure 4:
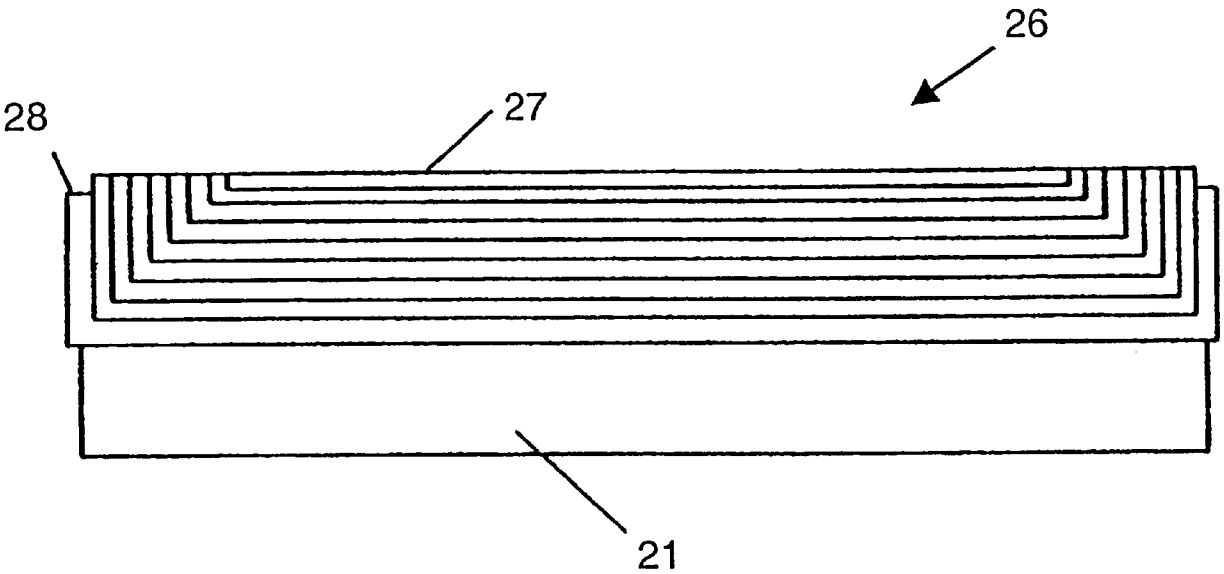
FIG. 4 is a side view showing an arrangement of a coil and an induction heater, used in a printer of the present invention.
Figure 3:
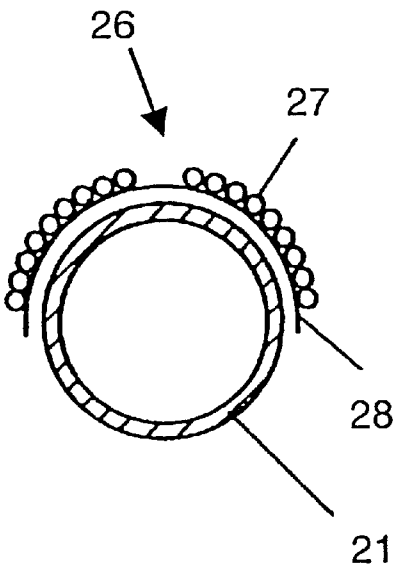
FIG. 3 is a cross sectional view showing an arrangement of an induction coil used in a printer of the present invention.

FIG. 3 shows a cross sectional view in part of the induction heating means or induction heater 26, while FIG. 4 shows a side view in part of the induction heating means or induction heater 26.

As shown in FIG. 3 and FIG. 4, the induction heating means or induction heater 26, which heats the heating roller 21 by electromagnetic induction, comprises a coil 27, a magnetization means or a magnetizer, and a coil guiding plate 28 on which the magnetizing coil 27 is wound. The coil guiding plate 28 is half-cylindrical, and is disposed in the vicinity of the outer periphery of the heating roller 21. As FIG. 4 shows, the coil 27 is manufactured by alternately winding a long wire around the coil guiding plate 28, in a direction of the axis of the heating roller 21. The length of the coil is the same as the area where the belt 23 and the heating roller 21 come in contact.

This construction allows the heating roller 21 to have the largest possible area to be heated by the electromagnetic induction of the induction heating means or induction heater 26. Furthermore, the contact time between the heated surface of the heating roller 21 and belt 23 becomes as large as possible. Thus, the heat conduction efficiency to the belt 23 is increased.

The coil 27 is connected to a driving power source with a variable frequency oscillator.

Adjacent to the coil 27 is a half-cylindrical coil core 29 made of a ferromagnetic material such as ferrite, fixed on a coil core supporting member 20. In the present embodiment, the coil core 29 has a relative permeability of 2500.

The coil 27 is supplied with a high-frequency alternating current of 10 kHz–1 MHz, preferably 20 kHz–800 kHz from the driving power source, thereby the coil 27 generates an alternating field. At and around the contacting position W1 of the heating roller 21 and the heat resistant belt 23, the alternating field affects the heating roller 21 and the heating layer 23*a* of the belt 23, causing an eddy current I to flow in the heating roller 21 and the heating layer 23*a* in the direction B, a direction which prevents the alternating field from changing.

The eddy current I generates Joule heat according to the resistance of the heating roller 21 and the heating layer 23*a,* and, via the electromagnetic induction, heats up mainly at and around their contacting portion of the heating roller 21 and the belt 23 having the heating layer 23*a.*

The temperature of the inner surface of the belt 23 heated in the foregoing manner is measured in the vicinity of the entrance of the fixing nip portion N by a temperature sensor 25 made with high heat-responsive, temperature sensitive elements such as a thermistor disposed in contact with the inner surface of the belt 23.

With this construction, since the temperature sensor 25 does not damage the outer surface of the belt 23, a stable fixing capacity can be maintained and the temperature of the belt 23 just before entering in the fixing nip portion N can be detected. Based on the output signals providing the temperature information, the power input into the induction heating means or induction heater 26 can be controlled, thereby securely maintaining the temperature of the belt 23 at, for example, 180° C.

According to the present embodiment, since the fixing nip portion N is formed with the belt 23 which is heated by the heating roller 21 heated by the induction heating means or induction heater 26, and the press roller 24, differences in temperatures between the outer and inner surfaces of the belt 23 are restricted when the toner image T formed on the medium 17 in the image forming section (not illustrated) enters the fixing nip portion N. Therefore, so called overshoot, in which the temperature on the surface of the belt becomes excessively high compared with the set temperature, can be prevented. Thus, temperature of the belt 23, a toner heating medium, can be controlled in a stable manner.

Therefore, in the fixing process, the belt 23 whose temperature is a tightly controlled constant comes in contact with the toner image T, securing a high fixing quality.

The fixing device of a second exemplary embodiment is described below. As FIG. 6 shows, in the second embodiment of the fixing device, an induction heating means or induction heater 32 comprises a coil 33, a coil guiding plate 34 on which the coil 33 is wound, and a coil core 35 fixed by a coil core supporting member 36, which is disposed adjacent to the coil 33.

In this device, the heating area W2 is approximately half of the contact area of the half-cylindrical induction heating means or induction heater 32, since the induction heating means or induction heater 32 is a quarter-cylindrical. The other constituent components of the present fixing device remain the same as those in the previous embodiment.

Figure 6:
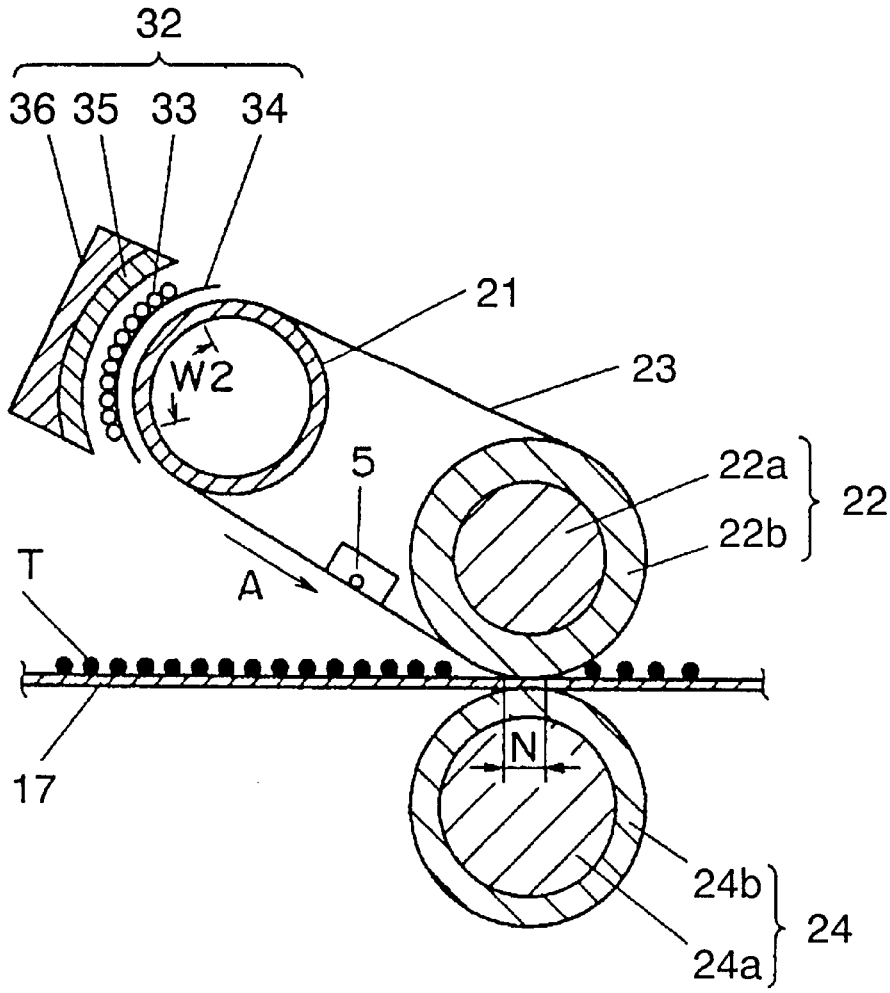
FIG. 6 shows a fixing device in accordance with another exemplary embodiment of the present invention.

As shown in FIG. 6, the centers of the fixing roller 22, the coil 33, the coil guiding plate 34 and the coil core 35 are located on a substantially straight line.

With such a construction, the size of the induction heating means or induction heater 32 can be made small, which leads to a fixing device that is compact in dimensions and lower in parts cost.

According to the present invention, the fixing nip portion comprises a toner heating medium which is heated by the heating roller heated by the induction heating means or induction heater, and a press roller. Due to this construction, temperatures of the outer and inner surfaces of the toner heating medium are kept almost the same when entering the fixing nip portion. Therefore, temperatures of the toner heating medium can be controlled in a stable manner. Thus, the printer of the present invention provides quality prints on stable basis.

What is claimed is:

1. A printer comprising:

an exposure device operable to generate a light beam corresponding to image information;

a photosensitive body on which a latent image is formed based on the light beam delivered from said exposure device;

a charger operable to charge said photosensitive body;

a developer operable to convert the latent image formed on said photosensitive body into a visible image using toner particles;

a belt on which the visible toner image is transferred; and a fixing device operable to fix the visible toner image onto a recording medium, said fixing device comprising:

a heating roller comprising magnetic metal;

a fixing roller disposed parallel to said heating roller;

an endless belt bridging said heating roller and said fixing roller;

a press roller pressed to said fixing roller via said endless belt and the recording medium; and a device operable to produce magnetic fields disposed adjacent to said heating roller, wherein said device heats both of said heating roller and said endless belt and a surface of said endless belt is coated with a resilient layer having a thickness of 100–300 $\mu$m.

2. The printer of claim 1, wherein said endless belt comprises a heat-resistive resin disposed on a magnetic metal, said heat-resistive resin making contact with the recording medium.

3. The printer of claim 1, wherein said endless belt is made of an electro-conductive composite resin.

4. The printer of claim 1, wherein said resilient layer has a releasing ability.

5. The printer of claim 1, wherein said device operable to produce magnetic fields is disposed along an external periphery of said heating roller for a length substantially the same as a contact arc between said heating roller and said endless belt.

6. The printer of claim 1, wherein said device operable to produce magnetic fields is disposed along an external periphery of said heating roller for a length shorter than a contact arc between said heating roller and said endless belt.

7. The printer of claim 1, wherein an external diameter of said heating roller is smaller than an external diameter of said fixing roller.

8. The printer of claim 1, further comprising a temperature sensor operable to detect a temperature of said endless belt, said temperature sensor being disposed at a vicinity of a point of contact between said fixing roller and said press roller, and said temperature sensor contacting an inner surface of said endless belt.

9. The printer of claim 1, wherein the surface of said press roller is covered with a resilient silicone resin.

10. The printer of claim 1, wherein said press roller presses into the surface of said fixing roller.

11. The printer of claim 1, wherein said endless belt comprises a magnetic material having a thickness in a range of 20–50 $\mu$m.

12. A fixing device comprising:

a heating roller comprising magnetic metal;

a fixing roller disposed parallel to said heating roller;

an endless belt containing magnetic metal, said endless belt bridging said heating roller and said fixing roller;

a press roller pressed to said fixing roller via said endless belt and a recording medium; and a device operable to produce magnetic fields disposed adjacent to said heating roller, the magnetic fields heating both of said heating roller and said endless belt, wherein a surface of said endless belt is coated with a resilient layer having a thickness of 100–300 $\mu$m.

13. The fixing device of claim 12, wherein said endless belt comprises a heat-resistive resin disposed on a magnetic metal, said heat-resistive resin making contact with the recording medium.

14. The fixing device of claim 12, wherein said endless belt is made of an electro-conductive composite resin.

15. The fixing device of claim 12, wherein said resilient layer has a releasing ability.

16. The fixing device of claim 12, wherein said device operable to produce magnetic fields is disposed along an external periphery of said heating roller for a length substantially the same as a contact arc between said heating roller and said endless belt.

17. The fixing device of claim 12, wherein said device operable to produce magnetic fields is disposed along an external periphery of said heating roller for a length shorter than a contact arc between said heating roller and said endless belt.

18. The fixing device of claim 12, wherein an external diameter of said heating roller is smaller than an external diameter of said fixing roller.

19. The fixing device of claim 12, further comprising a temperature sensor operable to detect a temperature of said endless belt, said temperature sensor being disposed at a vicinity of a point of contact between said fixing roller and said press roller, and said temperature sensor contacting an inner surface of said endless belt.

20. The fixing device of claim 12, wherein the surface of said press roller is covered with a resilient silicone resin.

21. The fixing device of claim 12, wherein said press roller presses into the surface of said fixing roller.

22. The printer of claim 12, wherein said magnetic material has a thickness in a range of 20–50 $\mu$m.

* * * * *